US007882839B2

(12) United States Patent
Ambis, Jr.

(10) Patent No.: US 7,882,839 B2
(45) Date of Patent: Feb. 8, 2011

(54) CUSTOM MOUTHGUARD

(76) Inventor: Edward J. Ambis, Jr., 208 Texas La., Ithaca, NY (US) 14850

( * ) Notice: Subject to any disclaimer, the term of this patent is extended or adjusted under 35 U.S.C. 154(b) by 0 days.

(21) Appl. No.: 10/876,501

(22) Filed: Jun. 25, 2004

(65) Prior Publication Data

US 2005/0284489 A1 Dec. 29, 2005

(51) Int. Cl.
*A61C 5/14* (2006.01)

(52) U.S. Cl. ..... 128/861

(58) Field of Classification Search ..... 128/848, 128/859, 861, 862; 433/6
See application file for complete search history.

(56) References Cited

U.S. PATENT DOCUMENTS

| | | | | |
|---|---|---|---|---|
| 1,843,337 | A * | 2/1932 | Record et al. | 128/861 |
| 2,643,652 | A * | 6/1953 | Cathcart | 128/861 |
| 2,966,908 | A * | 1/1961 | Cathcart et al. | 128/861 |
| 3,107,668 | A * | 10/1963 | Thompson | 128/861 |
| 3,407,808 | A * | 10/1968 | Baldwin | 128/862 |
| 4,508,506 | A | 4/1985 | Jackson | |
| 4,672,959 | A | 6/1987 | May | |
| 4,848,365 | A * | 7/1989 | Guarlotti et al. | 128/859 |
| 5,003,994 | A * | 4/1991 | Cook | 128/848 |
| 5,347,454 | A | 9/1994 | Mushabac | |
| 5,752,826 | A | 5/1998 | Andreiko | |
| 6,691,710 | B2 | 2/2004 | Kittlesen | |
| 6,837,246 | B1 * | 1/2005 | DeLuke | 128/860 |

OTHER PUBLICATIONS

Deyoung, A.K. et al.,Comparing Comfort and Wearability, J.A.D.A. vol. 125, pp. 1112-1117, Aug. 1994.
Gilboe, D.B., Centric Relation as the Treatment Position, J.Prosthetic Dentistry, vol. 50,pp. 685-689, Nov. 1983.
Gilboe,D.B., Posterior Condylar Displacement: Prosthetic Therapy, J. Prosthetic Dentistry, vol. 49, pp. 549-553, Apr. 1983.
Hickey,J.C. et al., The Relation of Mouth Protectors to Cranial Pressure J.A.D.A. vol. 74, pp. 735-740, Mar. 1967.
Keith, D.A. et al., Orofacial Athletic Injuries, J.Mass.Dental Soc., vol. 43, pp. 11-15, Oct. 1986.
Scott,J.et al., A Review of Dental Injuries & Use of Mouthguards Br.Dental.J., vol. 176, pp. 310-314, 1994.
Westerman,B. et al., EVA Mouthguards:How Thick Should They Be? Dental Traumatology, vol. 18,pp. 24-27, 2002.
Woodmansey,K.F., Athletic Mouth Guards Prevent Orofacial Injuries Gen.Dentistry, pp. 64-69 Jan. 1999.

* cited by examiner

*Primary Examiner*—Patricia M Bianco
*Assistant Examiner*—Camtu T Nguyen
(74) *Attorney, Agent, or Firm*—Robert A. Elwell; Gregory F. Jacobs

(57) ABSTRACT

A custom mouthguard has a resilient U-shaped body with an anterior wall and a posterior wall. A post dam on the posterior wall forms a seal with palatal tissue to increase retention of the mouthguard in a wearer's mouth. The increased retention allows a wearer to speak and open mouth breath while wearing the mouthguarrd. The mouth guard also has an indexed region that serves to mutually stabilize maxillary teeth, mandibular teeth, mandible and TMJ components. Mouthguard methods and processes are also disclosed.

1 Claim, 10 Drawing Sheets

CUSTOM MOUTHGUARD

BACKGROUND OF INVENTION

The present invention relates to protective equipment, and, in particular, relates to protective equipment for human teeth.

Mouthguards and related teeth protective equipment have been known since approximately the year 1900. (Scott, J., Burke, F. J. T. and Watts, D. C.; Br Dent J. 1994; 176: 310-314). In general, known mouthguards share characteristic deficiencies in comfort afforded a wearer. (DeYoung, Amy Kay, Robinson, Emerson and Goodwin, William C. JADA, v. 125, August, 1994, pp. 1112-1117. Woodmansey, Karl F. General Dentistry, January-February 1999, pp. 64-69.) Known mouthguards typically degrade or impede a wearer's breathing and/or speech. Moreover, known mouthguards are often subjectively considered detrimental to the appearance of wearers.

One consequence of these characteristic shortcomings is a nearly universal disdain and avoidance of use by those potential wearers who are most likely to benefit from such protective equipment. While those potential wearers may be temporarily compelled to wear such protective equipment when under the supervision of an authority figure, they often discard, lose, hide or otherwise avoid wearing such protective equipment within moments after their supervision is relaxed or terminated. Unfortunately, the dangers remain and too often, teeth are then damaged or lost. (Ibid)

Thus, there remains a need for a mouthguard that is protective, comfortable, does not interfere with breathing, and allows speech by a wearer. Preferrably, such a mouthguard would not render the wearer less attractive. Such a device would eliminate much of the motivation to avoid wearing mouthguards and thereby increase comfort and pleasure while affording wearers a longer period of time during which they are protected from danger. Moreover, if the protective characteristics of such a device, when actually worn, were to exceed the protection afforded by known mouthguards, when actually worn, then a substantial increase in safety would occur. In other words, a substantially safer mouthguard would be relatively more effective in protecting teeth against a given blow and would be worn for a greater proportion of the time when danger is present. A wearer of a substantially safer mouthguard would enjoy a greater level of safety over a longer time frame with greater comfort, unimpeded open-mouth breathing, still able to speak and not become less attractive. Thus, a recognition and appreciation of a variety of significant mouthguard characteristics must be incorporated to develop a substantially safer mouthguard.

Some known mouthguards also claim an ability to improve protection of body structures other than teeth, e.g. the temporomandibular joints and brain. There remains an opportunity and need for a more critical consideration of the protection afforded by these known mouthguards. A better understanding of such protection might allow advances in protection to be considered and incorporated into the earlier mentioned substantially safer mouthguard.

There have been a number of studies and articles in relevant literature that, although not reaching the present invention may warrant review as background in understanding the present invention:

1. DeYoung, Amy Kay, Robinson, Emerson and Goodwin, William C. Journal of the American Dental Association, v. 125, pp. 1112-1117, August, 1994.

2. Gilboe, Dennis B., Centric Relation as the Treatment Position, Journal of Prosthetic Dentistry, 50:5, pp. 685-689, 1983.

3. Gilboe, Dennis B., Posterior Condylar Displacement: Prosthetic Therapy, Journal of Prosthetic Dentistry, 49:4, pp. 549-553, 1983.

4. Hickey, Judson C., Morris, Alvin L., Carison, Loren D., Seward, Thomas E., The Relation of Mouth Protectors to Cranial Pressure and Deformation, Journal of the American Dental Association, v. 74, pp. 735-740, March, 1967.

5. Keith, David A., Orden, Adam L., Orofacial Athletic Injuiries and Involvement of the Temporomandibular Joint, Journal of the Massachusetts Dental Society, v. 43: 4, 11-15, 1986.

6. Scott, J, Burke, F. J. T. and Watts, D. C., A Review of Dental Injuries and the Use of Mouthguards in Contact Team Sports; Br Dent J.; 176: 310-314, 1994.

7. Westerman B, Stringfellow P M, Eccleston J A. EVA Mouthguards: How Thick Should They be? Dental Traumatology: 18, 24-27, 2002.

8. Woodmansey, Karl F., Athletic Mouth Guards Prevent Orofacial Injuries: A Review General Dentistry, January-February, pp. 64-69, 1999.

The present invention, disclosed subsequently, addresses these many issues and challenges by applying critical and innovative thinking to the functions and mechanisms through which mouthguards protect a wearer. Additionally, the present invention, disclosed subsequently, includes innovative methods of making and using such mouthguards.

SUMMARY OF THE INVENTION

The present invention, in a first embodiment, is a heat and pressure formed custom mouthguard that protects maxillary and mandibular teeth, stabilizes temporomandibular joints, maximizes jaw muscle comfort and facilitates speech and breathing.

A mouthguard, according to the present invention, allows individuals wearing the mouthguard to speak easily and relatively naturally while still protecting their teeth and jaws and jaw joints. The ability to speak while wearing this mouthguard is due, in one aspect, to the relatively small size of the new mouthguard in comparison to known mouthguards. By using anatomical relationships heretofore ignored or discarded in known mouthguards, the mouthguard of the present invention allows for greater retention, stabilizes the temporomandibular joints, maximizes jaw muscle comfort and allows a wearer to speak easily. The upper anterior extent of the inventive mouthguard is matched with or generally level with the upper posterior extent. This anatomically matching relationship serves to maximize retentive fit on the teeth and soft tissue.

The mouthguard of the present invention is formed, in a preferred embodiment, through a combined use of heat and pressure about a dental cast or form that is largely representative of the maxillary anatomical structures that are to be protected. One preferred method of formation involves use of a machine such as a BioStar machine (available from Great Lakes Orthodontics of Buffalo, N.Y.) which machine heats a sheet of laminate thermoplastic material and pressure forms the heated sheet over a dental cast and into a close molded conformance therewith. Prior to such molding, the dental cast is modified to alter the resulting shape of the sheet being molded or formed. The sheet is subsequently trimmed to discard unwanted portions, thereby leaving a mouthguard of the present invention. The resultant mouthguard is extremely close fitting or conforming to certain teeth and portions of the maxilla. This close fit, in turn, renders the mouthguard of the present invention extremely retentive. One modification of the dental cast creates a significant or key structure of the mouthguard that further enhances its retentive property once fitted to the wearer. The dental cast is made of dental stone material. The modification of the dental cast removes a small portion of dental stone material in certain regions of the dental cast. In turn, this small portion of removed material eventually results in a mouthguard that is functionally and effectively more closely in contact with portions or regions of the wearer's mouth. That is, the resulting mouthguard is resiliently contacting the tissue within the wearer's mouth; and most specifically the mouthguard is resiliently contacting the wearer's mouth, including intaglio surfaces, with portions of the mouthguard that are the direct result of the modification to the dental cast. This added retention makes speaking and/or breathing easy and relatively natural for a wearer of the inventive mouthguard. A second modification alters the shape of the dental cast by removing a portion of the dental cast corresponding to the hard palate; in particular a portion posterior to the section that will be used to form or mold the sheet material to form the inventive mouthguard is removed.

In another embodiment of the present invention, the inventive mouthguard also includes an anterior stop for the lower teeth of the wearer. By providing an anterior stop for the lower teeth against the posterior surface of the mouthguard while upon the upper teeth, the wearer's molars do not touch. As a result, in turn, molar prematurities are avoided. The closing masticatory muscles help seat the condylar heads in the condyle-disk assembly and stabilize the temporomandibular joints for any impact to the mandible. (Gilboe, Dennis B., J. Pros. D., 49:4, pp. 549-553) The inventive mouthguard allows such seating of the condylar heads to occur while the mouthguard is in place.

The present invention is particularly useful due to the increased compliance by athletes. The inventor has informally observed that athletes afforded an opportunity to wear a mouthguards of the present invention, are far more likely to continue wearing the mouthguards without enforced monitoring of required wearing because of the comfort associated with the inventive mouthguard and because of low impact on speech and/or breathing. On a wider scale, the availability of such an inventive mouthguard would allow athletes to benefit from the general health and safety benefits generally associated with mouthguards while simultaneously avoiding some of the most notorious and least desirable side effects. Examples of such avoidable effects include bulkiness, pinching of gum tissue, gagging, looseness, bad taste, soreness of masticatory muscles, and restricting breathing.

Other known mouthguards exist but the present invention is believed distinct and superior because: First, the present inventive mouthguard maximizes retention using and innovatively exploiting naturally present anatomy of the anterior upper jaw. Second, the inventive mouthguard is specially shaped to substantially avoid facial and jaw muscle soreness, which soreness is believed to result from a condition of extended periods of enduring molar occlusal prematurities (or poor bite) associated with known mouthguards. Third, the present inventive mouthguard is not subject to shredding, flattening, or similar deterioration between the wearer's back teeth. Fourth, the present inventive mouthguard does not loosen up or otherwise detrimentally change shape with extended use. Moreover, the present inventive mouthguard stabilizes the wearer's temporomandibular joints in a position that optimally or nearly optimally resists a potentially damaging force. Further, the present inventive mouthguard contributes to stabilizing the lower jaw from lateral blows. In addition, the present invention decreases the amount of force transmitted to the cranium from blows to the lower jaw by serving as a damper to such undesireable force.

Perhaps most significantly from a health and safety view point, the present invention allows easy breathing so as to encourage compliance, thereby increasing the probability the wearer will benefit from the incorporated protection features. Comfort and thereby compliance, and in turn overall probability of protection, is also increased by the general lack of distortion of the wearer's upper lip. Moreover, the lack of distortion in the wearer's upper lip is not detrimental to the wearer's appearance, thereby reducing objections based upon the wearer's vanity and again, in turn, increasing the probability that the inventive mouthguard's protective capabilities will be available to a potential wearer when actually needed.

DETAILED DESCRIPTION OF THE INVENTION

Figure 1:
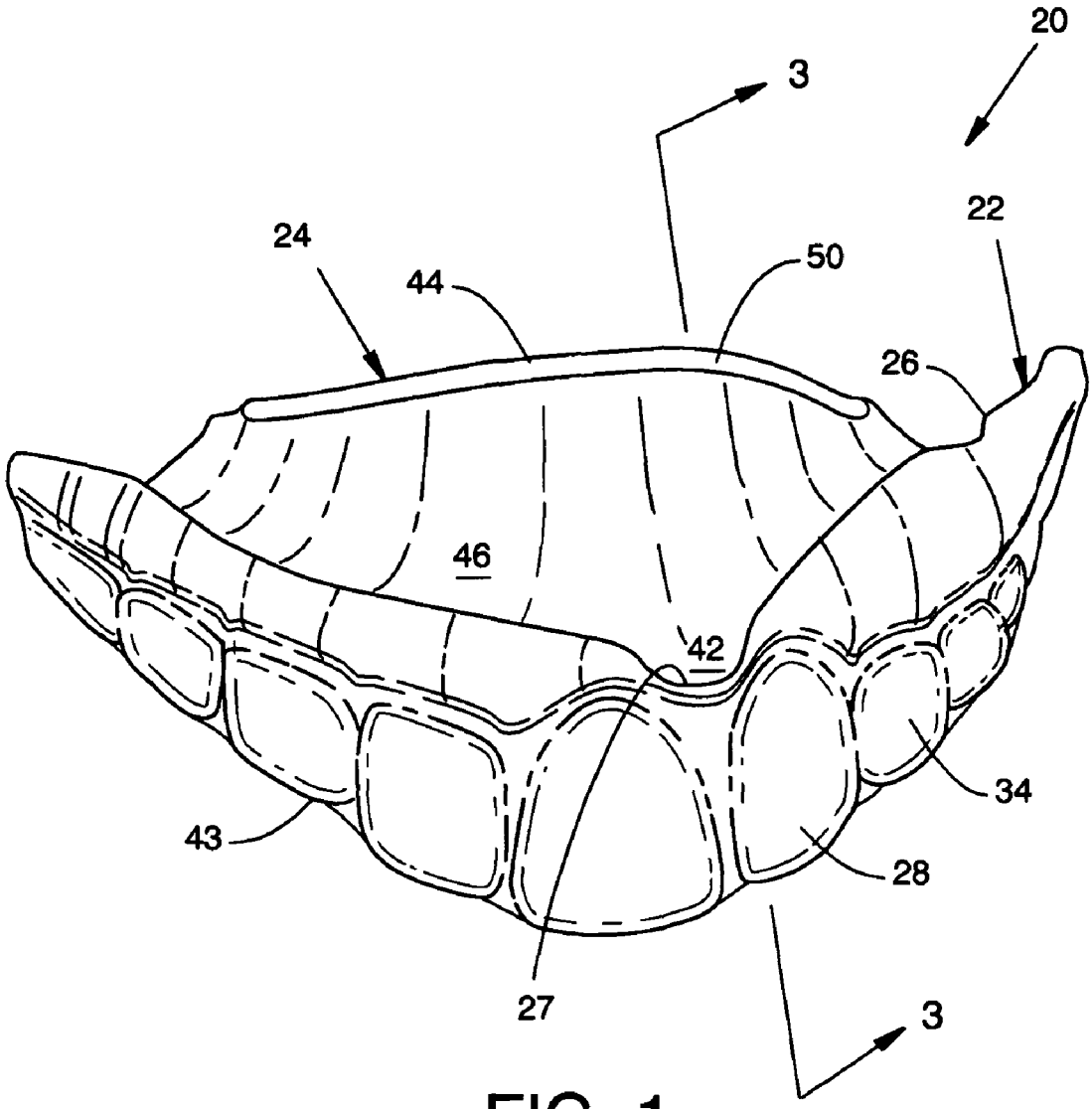
FIG. 1 is an isometric view showing the top of the mouthguard, the present invention, and also showing the post dam element of the mouthguard.

In a first embodiment, the present invention is a mouthguard 20, as shown in FIG. 1. The mouthguard 20 includes an anterior portion or wall 22 and a posterior portion or wall 24. The anterior wall 22 has an upper edge or extent 26 and a lower portion 28. A slight dip or notch 27 is centered on the upper extent 26 of anterior wall 22. The notch 27 accommodates the frenum (or frenulum) of the wearer, thereby allowing portions of the anterior wall 22 to reach higher on the gum 60 (as shown in FIG. 3). The anterior wall 22 has a curved shape and is adapted and custom fit and shaped for close conformance to the forward surfaces of the maxillary anterior teeth and gingival tissue of a wearer of the mouthguard 20. In particular, the anterior wall 22 has an inwardly directed surface 32 (perhaps best viewed in FIG. 2) which is adapted and shaped to contact the forward surfaces of the wearer's anterior teeth and gingiva and gums. The anterior wall 22 also has an outwardly directed surface 34 which may be contacted by the wearer's upper lip. For a typical wearer, the frontward or outwardly directed surfaces of the following teeth are typically fit to the anterior wall surface 32: the four incisor teeth, the two canine or cuspid teeth and the two premolar teeth on each side, and/or the forward most molar if a premolar is missing. In other words, the mouthguard 20 is generally centered on the midline of the upper or maxillary jaw and encloses only the front ten teeth, i.e. the first five teeth on each side of the midline of the maxillary jaw. The outwardly directed surface 34 typically reflects the general shape and contour of the forward surfaces of the above-mentioned wearer's anterior teeth.

The posterior wall 24 of mouthguard 20 is connected to the lower portion 28 of the anterior wall 22 by a lower portion 42, together lower portions 28 and 42 define a bottom 43 of the mouthguard 20 which bottom 43 generally has an overall U-shape, when viewed from above or below. The posterior wall 24 also has an upper edge or extent 44. The inwardly directed surface 46 of the posterior wall 24 is adapted and shaped to closely conform to the posterior surfaces of the anterior teeth of a wearer, most typically the foremost ten teeth, as well as adjoining regions of the wearer's palate. The inwardly directed surface 46 of the posterior wall 24 is generally facing toward the inwardly directed surface 32 of the anterior wall 22. The posterior wall 24 also has an outwardly directed surface 48 (perhaps best shown in FIG. 2.) The outwardly directed surface 48 typically is in intermittent contact with the wearer's tongue and has a shape generally reflective of the wearer's underlying teeth and palate. The posterior wall 24 and inwardly directed surface 46 thereof is also slightly inclined as well as having a general U-shape.

Situated on the inwardly directed surface 46 adjacent the upper edge 44 is a post dam 50. The post dam 50 is an exception to the conformity of the interior surface 46. The post dam 50 is a generally continuous ridge upon the inwardly directed surface 46. The purpose and function of the post dam 50 is to bear against the palatal tissue of the wearer. Such bearing against the palatal tissue, in turn, tends to resiliently seal the mouthguard 20 to the wearer's palate.

Figure 2:
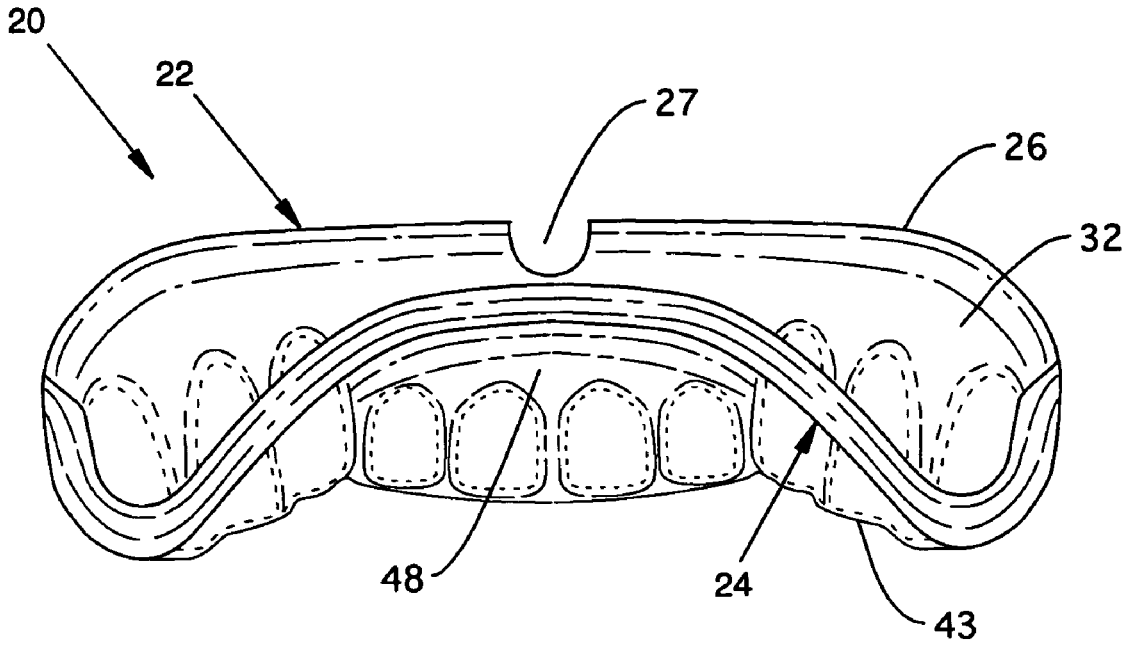
FIG. 2 is a rear view of the mouthguard of FIG. 1.
Figure 3:
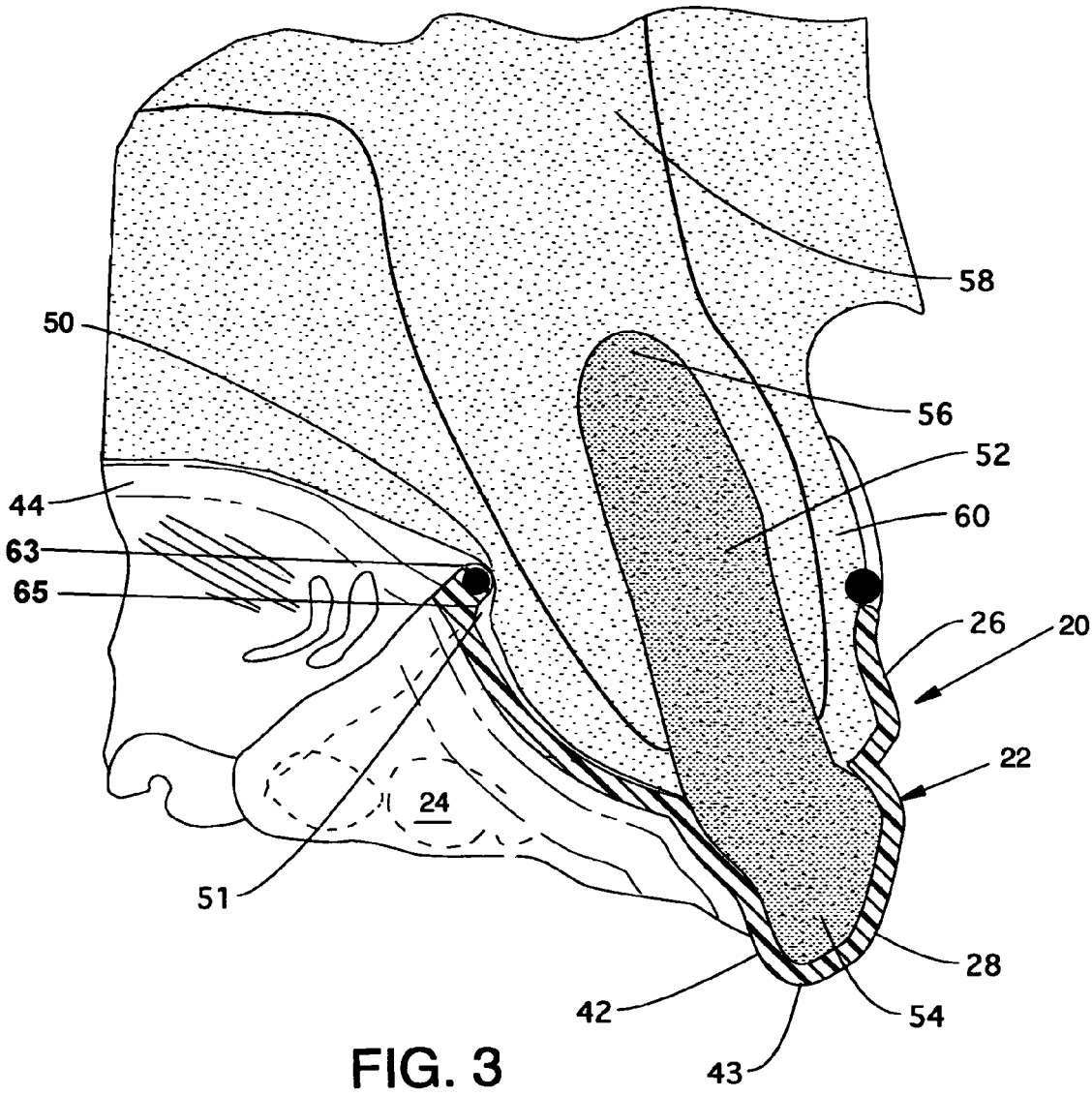
FIG. 3 is a sectional view at 3-3 of FIG. 1 and additionally schematically showing certain anatomical structures being protected within the mouthguard.
Figure 4:
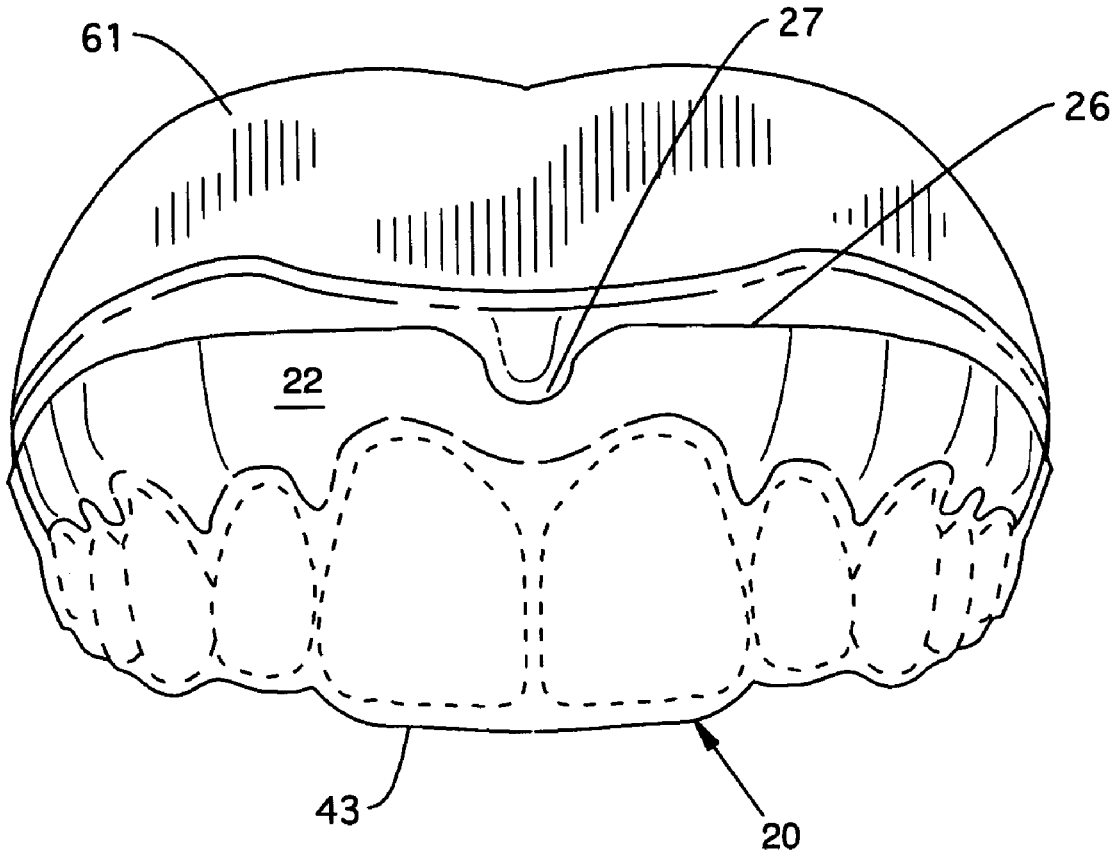
FIG. 4 is a buccal view of the mouthguard upon a dental cast.
Figure 5:
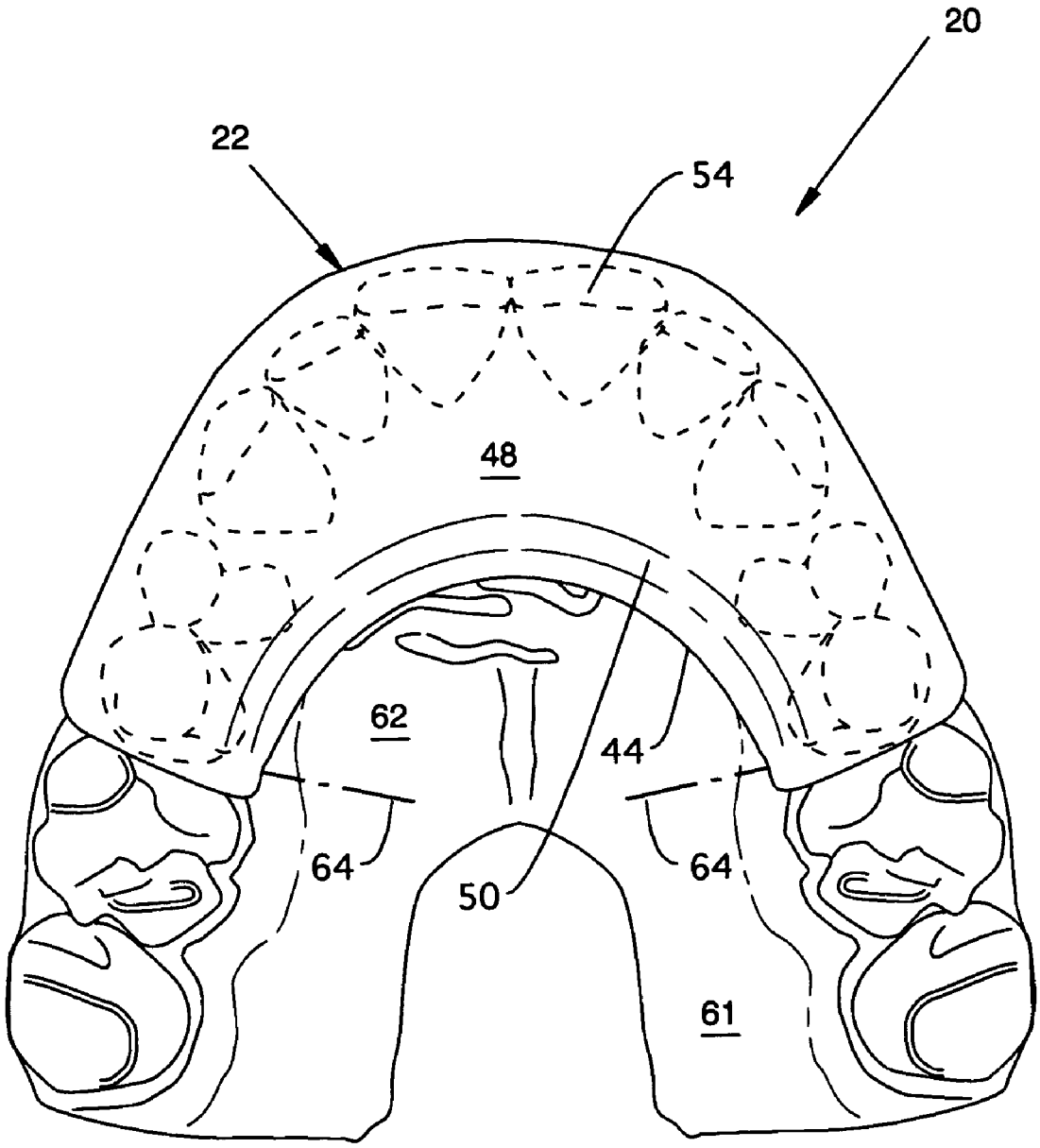
FIG. 5 is an occlusal view of the finished mouthguard upon a dental cast.

As shown in FIG. 2, inwardly directed surface 32 of the anterior wall 22 is directed toward the front surface of a wearer's teeth and a wearer's anterior gum 60 and conforms thereto. Rearward surface 48 of posterior wall 24 is directed for intermittent contact with a wearer's tongue. Notch 27 is situated to accommodate a wearer's frenum (or frenulum.)

The mouthguard 20 serves a protective role with respect to a wear's teeth as perhaps most easily comprehended with reference to FIG. 3, a cross-sectional view near midline of the maxillary jaw and showing schematically an incisor 52 having a crown 54 in the bottom 43 of mouthguard 20 and a root 56 generally above crown 54. The root 56 is anchored in bone 58 and protrudes downwardly through the gingiva, or gum 60. This incisor 52 may be considered exemplary of the other nine teeth protected by the mouthguard 20. Each of the ten teeth is prone to damage, for example, by blows hitting one or more of the teeth and potentially either fracturing, breaking, and/or displacing one or more of the teeth. The mouthguard 20 protects the ten teeth by cushioning them, by linking them together, (particularly in the areas about their crowns, because for example crown 54 has great leverage relative to root 56) and by linking them to the gum 60 and palate 62. One of the benefits of the present invention mouthguard 20 is that the mouthguard is remarkably comfortable to wear. In particular, the back extent of the guard comes up behind the anterior teeth, particularly in the area of the rugae, i.e. the rough spots on the front of the palate or roof of the mouth. This configuration means, in turn, that the ridge formed at the edge of the mouthguard 20 is in a position where the wearer's tongue is normally used to feeling roughness or texture, and, consequently, the wearing of the guard has a more natural feel to the wearer. If the back edge/ridge of the guard were to be placed higher up in the roof of the mouth, for example, as in the prior art U.S. Pat. No. 4,672,959 Robert May mouthguard, the wearer's tongue would feel it as something not natural, and there may be the discomfort of the feeling of a foreign object in the mouth, or possibly a tendency to work it with the tongue to possibly dislodge the guard unintentionally. Additional comfort and "natural" feeling of the mouthguard in a wearer's mouth increases compliance.

Method of Making the Mouthguard of the Present Invention

In a preferred embodiment, the mouthguard 20 is made as follows: First, an alginate impression is made of the maxillary teeth of a potential wearer. Other alternative impression materials include silicones, vinylpolysiloxanes, polyethers, however, alginate impressions are believed to be the most appropriate for the present invention.

The alginate impression preferably is made within a "shorter than usual impression tray." By "shorter than usual impression tray" herein is meant an impression tray which is shorter than a typical dental impression tray in that it does not extend posteriorly as far as conventional impression trays. The "shorter than usual impression tray" tends to minimize the amount of unhardened alginate impression material necessary to make an alginate impression in the limited dental region of interest and to significantly reduce the probability that the unhardened alginate impression material would inadvertently escape in a posterior direction within the potential wearer's mouth and gag or otherwise compromise a potential wearer. Note that the preferred "shorter than usual impression tray" does not extend as far back into a potential wearer's mouth so that the gag reflex is also less likely to be triggered. The "shorter than usual impression tray" of this invention was invented and developed for use in the method of making the mouthguard 20 of the present invention. To make the "shorter than usual impression tray" from a standard impression tray of the dental trade, the posterior border of the shortened tray is sealed off with either a periphery wax or other suitable material. Preferably, the "shorter than usual impression tray" accomodates the potential wearer's first five teeth on either side, for a total of ten teeth. However, a "shorter than usual impression tray" need, at minimum, only accommodate only the first ten teeth and, at maximum, would not extend to accommodate a full set of teeth. While the mouthguard 20 of the present invention could, alternatively but less desirably, be made using a standard impression tray, the comfort to the future wearer is promoted and enhanced by use of the "shorter than usual impression tray" in this step.

Figure 6:
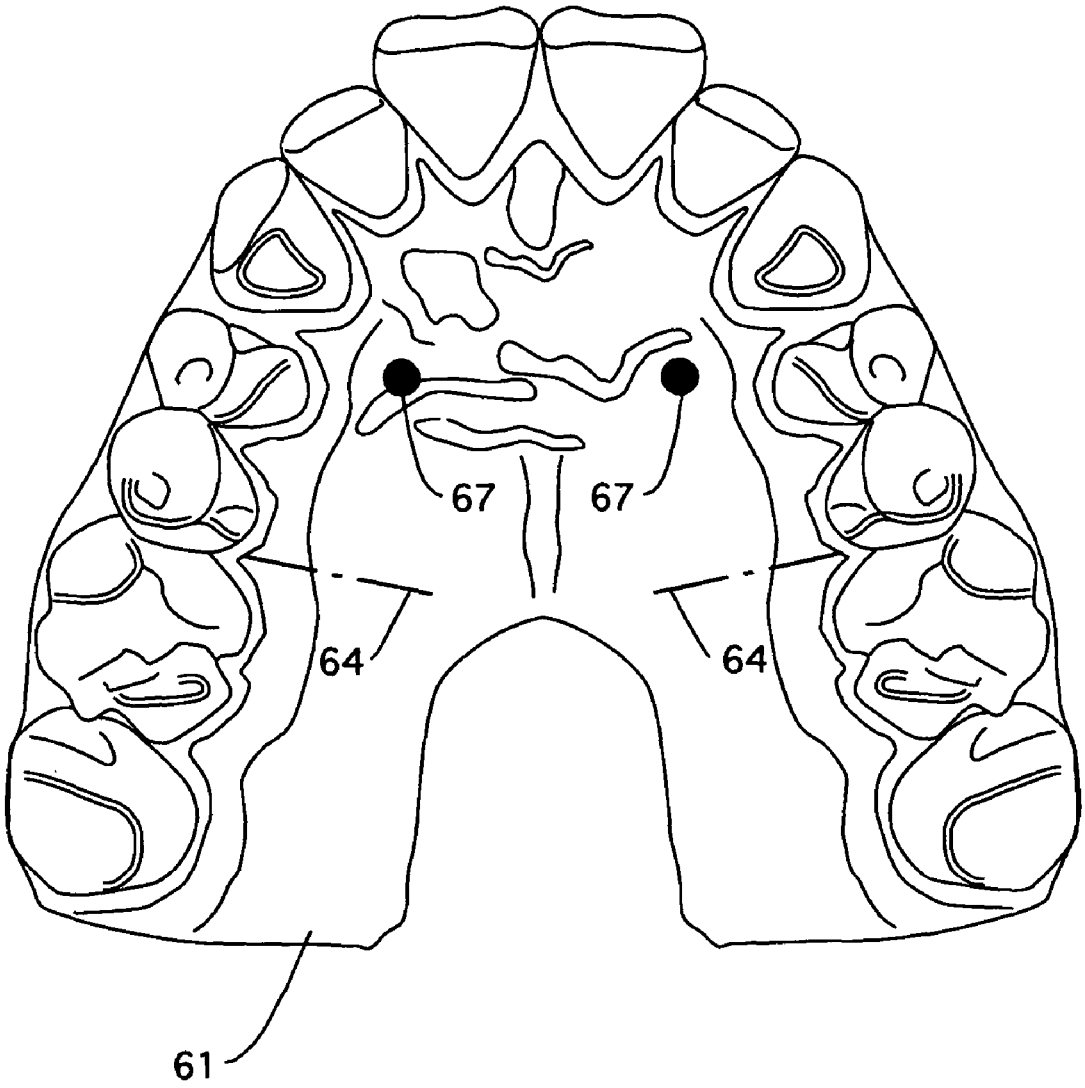
FIG. 6 is an occlusal view of a maxillary dental cast showing palatal reference points.

The resulting alginate impression is used to pour up a cast of the maxilla structure of the potential wearer. The cast 61 resulting is made of dental stone. After the dental stone has set, the cast of the maxilla is trimmed to a "horseshoe" shape and so that the palate is partially removed as shown in FIG. 6. The partial removal of palate in the dental cast is preferably accomplished using a model trimmer or a bench top model former. A portion of the hard palate is removed posterior to the first molars. More specifically, the dental cast portion representative of the hard palate from approximately the mesial of the first molars and anteriorly is necessary to prepare the mouthguard of this invention. Thus, this portion of the dental cast should be preserved and not removed. However, for ease of explanation and understanding, the production of a mouthguard 20 is illustrated herein with full maxillary dental cast of a mouth wherein wisdom teeth are either not yet present, or have been removed.

Figure 8:
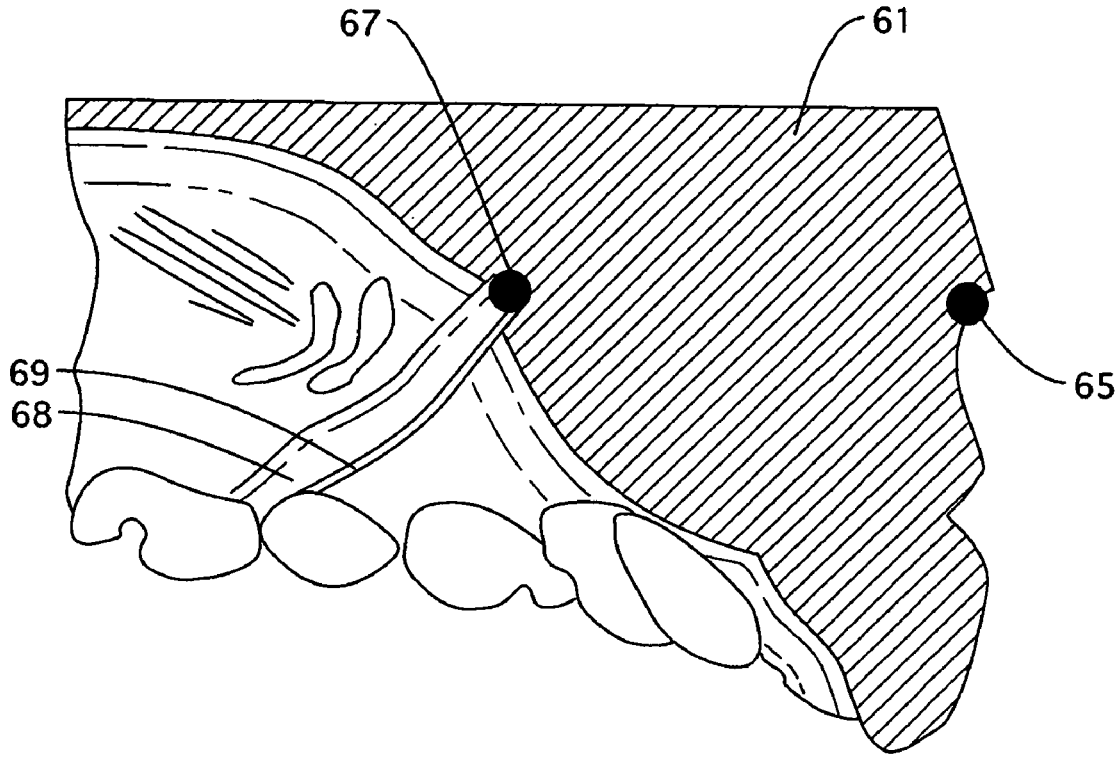
FIG. 8 is a cross-sectional view of a maxillary dental cast at 8-8 of FIG. 7 and showing post dam machining.
Figure 9:
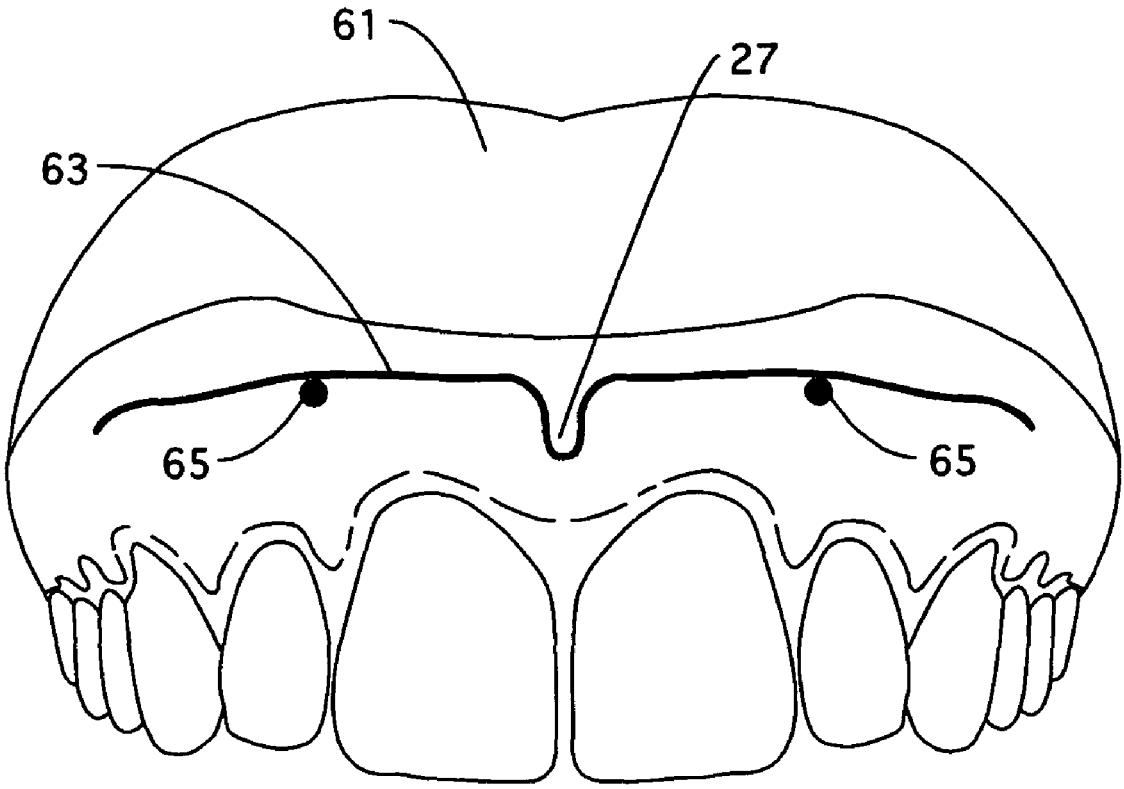
FIG. 9 is a buccal view of the dental cast and showing the anterior outline of the height of the muccobuccal fold marked to show the anterior upper extent where the mouthguard is to be trimmed; and, FIG. 10 is a sectional view at 8-8 of FIG. 7 and the just formed mouthguard, trimmed and re-installed upon the modified maxillary dental cast.
Figure 10:
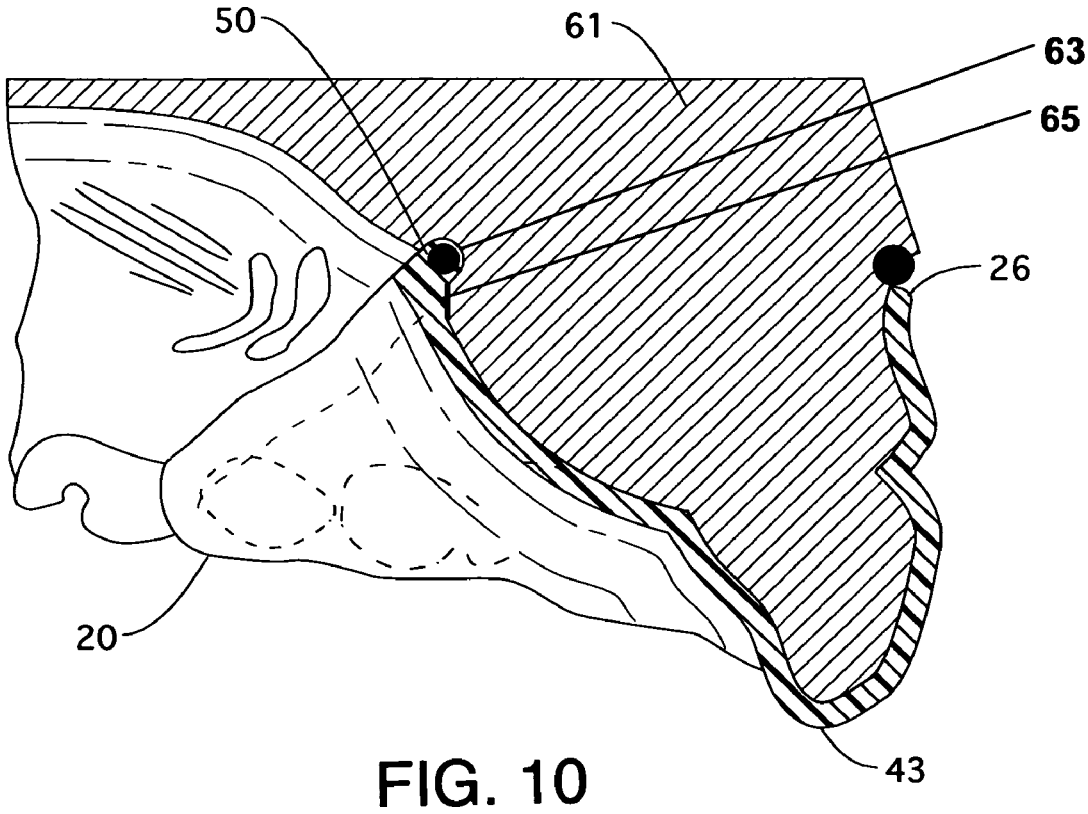

Next, reference lines 64 on FIG. 6 for establishing the anterior and posterior extents of the mouthguard are made on the dental cast. From these reference lines 64, the position corresponding to the post dam 50 of the mouthguard 20 can be defined upon the dental cast 61. Significant in locating the position of the post dam 50 are reference points 67 on the palate. The first line drawn upon the dental cast 61 is from the interproximal area between the first molar and the next mesial tooth superiorly to the height of the roof of the palate. The second line has the same origin, moves superiorly but is angled further towards the anterior to intersect a point that is even with a point 67 marking the most superior extent of the muccobuccal fold. With the outline of the post dam 50 of the mouthguard 20 established, the initial cut for the post dam, or posterior palatal seal, is performed. This step is preferably accomplished with a lab hand piece and a #8 or #10 round bur. The resulting groove 68 is shown sectionally and across remaining surface structure of the dental cast in FIG. 8. Preferably, the groove 68 is formed in two successive steps. First, the lab hand piece and #8 or #10 bur are applied to the desired line. Second, subsequent to the initial cut, a second cut is performed that bevels 69 the anterior edge of the post dam 50 approximately forty-five degrees. A cylindrical lab bur works well for this procedure.

Figure 7:
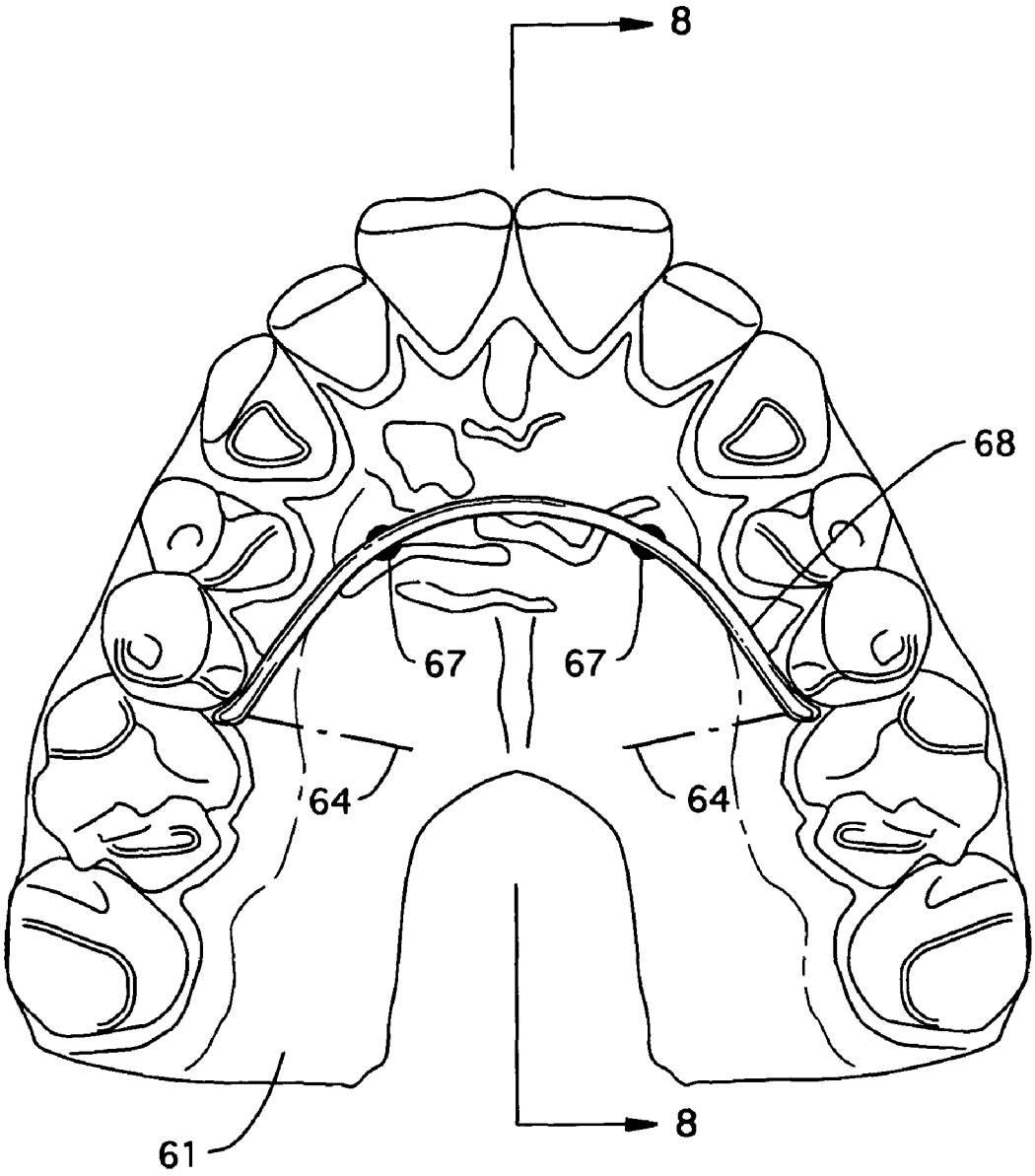
FIG. 7 is an occlusal view of the maxillary dental cast modified to allow molding of the mouthguard and showing the positioning of the post dam modification machining.

The advantage of this system of retention is that the anterior and posterior walls form an approximate "U". In some cases, the anterior extent of the mouth guard engages undercuts formed by the alveolar ridge (see FIGS. 7 and 8.) This "U" shaped design is one of the most important unique features of mouthguard of the present invention. By way of expanded explanation, retention in dental restorations such as crowns is dependent on the relative parallelism of the walls of the preparation. This aspect of preparation design is referred to as the "retention form." Considering analogously, stacked dispensible paper cups, such as "Dixie brand paper cups," will stack on each other and be retentive relative to each other due to the closeness of fit and parallelism of the walls of the paper cups. Similarly, so too the present invention mouthguard has greater retention in the wearer's mouth because the front and the back walls are more parallel than known prior art mouth guard designs. The present invention mouthguard cannot be ejected by the wearer's tongue. Forced removal by fingers is the only way to remove the present invention mouthguard from the wearer's mouth.

The dental cast 61, having a groove 68 prepared for the post darn, is now ready for the mouthguard material to be formed or conformed to the modified shape. This step is preferably performed with use of a heat and pressure-forming device. One such suitable device is a Biostar machine (available from Great Lakes Orthodontics, of Buffalo, N.Y.). Following the heat and pressure forming of the sheet into a mouthguard-like shape, it is trimmed to its final form using dental lab shears and a lab bur and lab polishing stone in a lab hand piece. This results in a mouthguard 20.

Once formed, the mouthguard is checked for fit in the wearer's mouth. Then, the occlusal or biting surface of the mouthguard 20 is softened with a hand torch or other heating means for example, IR lamp, radiant heat source, Cal-Rod heater, and similar localized heating means, placed back into the mouth, and the wearer will close lightly to indent the chewing surface of the mouthguard 20 with the cusps of the lower jaw to a depth of approximately ½ mm-2 mm, preferably 1 mm-2 mm; this process is called "indexing."

Indexing a mouthguard 20 with the anterior mandibular teeth is unique to the present invention mouthguard 20. Indexing has a distinct advantage in that during the indexing process the closing muscles of the mouth engage only the front of the mouth (where the mouthguard is positioned upon the wearer's teeth) and help seat the temporomandibular joints into their medially braced positions against the petrous portions of the temporal bone where the condyle-disk assembly is best positioned to withstand force. In this position, the condyle rotates. With the mouth closed and the mouthguard 20 in place, any trauma to the mandible will only rotate the mandible into the mouthguard 20 which will dampen the movement of the mandible and decrease the magnitude of the force transmitted to the cranium as the mouthguard 20 absorbs energy as it is deformed during the trauma. It is also possible to make a mouthguard 20 of the present invention by other methods. One alternative method is to first digitally scan the maxilla in the area where the mouthguard 20 would fit. This digital scan represents a virtual cast of the maxilla. The digital scan, as a virtual cast, includes three-dimensional information of the maxilla, much as the physical cast 61 includes analog and physical information of the maxilla. Next, a cast of the teeth and associated maxilla is reproduced from the three dimensional digital information of the digital scan. This reproduced cast is then used to complete production of the mouthguard 20. The groove is either subsequently machined or cut into the cast or alternatively, the groove is added digitally, such that a separate machining or cutting step is not needed. Note that one advantage of this digital method is that no "traditional impression technique" would be necessary. It is further envisioned, that virtual imaging technique might also be employed to provide a three-dimensional model. Examples of techniques and equipment might be a CAT scan or an MRI dataset. These approaches could be subsequently digitized and then a physical model built up using rapid prototype methods for making the mouthguard or the model dental cast or the modified dental cast for use in molding a mouthguard. Alternatively, a mouthguard could be made by rapid prototype techniques if the materials were sufficiently developed to get appropriate mechanical properties and have the safety/toxicity guidelines for the materials established. Further, it should be noted that the modification, leading to the post dam being molded integrally, as part of the mouthguard, may be the product of human intervention in prescribing the appropriate modification, or alternatively, a digital three-dimensional model could be automatically prescribed a modification leading to the correct post dam. Further, transmission of the digital information/three-dimensional model information, before or after modification could be via the Internet or telephone lines, or other electronic or photonic transmission systems.

Another alternative method is to use a molded shell, using the general anatomical relationships described in this embodiment, to hold a second stage "lining material" in the shell intraorally to further refine the fit and retention of the mouthguard.

Another method is to place a material in the groove or machining for the post dam prior to use of the Biostar machine. This material may be the same as the sheet or alternatively a different material, different either in color or in physical properties or both. Subsequently, the heated softened sheet is pressure formed and the added material incorporated at the post dam 50 that serves to form a seal.

Method of Using the Mouthguard of the Present Invention

The mouthguard 20 of the present invention is used by first inserting the mouthguard into the mouth of a wearer for whom it has been custom prepared. During insertion, the mouthguard 20 is oriented such that the upper edges 26 and 44 are above the lower connected portions 28 and 42 at bottom 43. The mouthguard 20 is then positioned beneath the maxillary anterior ten teeth and raised or lifted. Next, the mouthguard 20 is lifted into a fitted position against and enclosing the maxillary anterior teeth. During this fitting, the mouthguard 20 is preferably seated with the wearer's tongue, mandibular teeth and optionally, the wearer's fingers. Simultaneously with the final movement of this upward directed seating, air and/or saliva previously residing upon or trapped between the inwardly directed surfaces 32 and 46 of the mouthguard 20 and the corresponding surfaces on the teeth, gums, and palate is expelled. Once completely fitted, there is at most a minimal space (or alternatively a thin film ) 51 between the mouthguard 20 and the teeth and palate. (In order to facilitate understanding, the film or space 51 is shown with exaggerated thickness in FIG. 3.) The post dam 50 may be understood as resiliently sealing minimal space/thin film 51. While not wishing to be bound by theory, the inability of air and or saliva to easily re-enter space 51 tends to hold the mouthguard 20 in position using van der Waals forces while allowing the wearer to temporarily cease application of the upward seating pressure, similar in direction but not extent, initially used to install the mouthguard 20 into such a "fitted" or desired wearing position. (It may be that further substitution or modification of the fluid in the thin film minimal space might afford even more extreme retention of the mouthguard in the wearer's mouth. In this alternative, the expanded group of fluids includes not only saliva, water, and/or air, but also a sports beverage and perhaps fluid choices employed to help further maintain adhesion such as a denture adhesive-like material. However, it should be emphasized that the basic mouthguard of the present invention demonstrates remarkably useful retention without specialized fluids.) During this temporary cessation of upward seating pressure, the wearer can speak or breathe with an open mouth. Furthermore, the mouthguard 20 is comfortable in this installed position. The comfort afforded the wearer, as will be explained subsequently, is the result of a number of characteristics of the present invention mouthguard. In particular, comfort generating characteristics of the inventive mouthguard include: reduced size of the mouthguard of the present invention relative to known prior art mouthguards, limited extent of the mouthguard of the present invention into the posterior of the mouth, and reduced strain on the jaw muscles due to the elimination of molar occlusal interferences which, if present, would compromise normal closing muscle function.

When installed, the mouthguard is also highly protective of the wearer's teeth and the relationship between the teeth and gums because the mouthguard has a thickness of from about two to about four millimeters. Alternatively, the preferred mouthguard has a separation between teeth, subsequent to indexing, of about 2.5 mm-3.0 mm. This thickness originates in the blank sheet used to form or mold the mouthguard over the dental cast 61. Suitable blank sheets are available from dental supply houses, such as Dental Resources, Delano, Minn. which carries the ProForm brand of blank sheets. Preferred blank sheets are laminated blanks sheets, such sheets being known in the industry. Further, the subsequent indexing step allows the wearer to bite against the mouthguard with his mandibular anterior teeth. The indexing region thereafter further stabilizes the maxillary anterior teeth, as well as stabilizing the mandibular anterior teeth and, in turn, stabilizes the mandible as well. The wearer is therefore relatively substantially better protected from the following types of often-dreaded injuries. (1) A blow to the maxillary anterior teeth. The mouthguard of the present invention provides better protection than known prior art mouthguards against such blows because of the substantial thickness of mouthguard material on the outside or buccal side of the maxillary teeth, and because of the thickness of mouthguard material between the maxillary and mandibular teeth, and because of the supporting resistance of the braced mandibular anterior teeth. (2) A blow to the mandibular anterior teeth. The mouthguard of the present invention provides better protection than known prior art mouthguards against such blows because of the thickness of mouthguard material between the mandibular and maxillary teeth. (3) A lateral blow to the mandible. The mouthguard of the present invention provides better protection than known prior art mouthguards against such blows because the indexing of the mandibular teeth into the mouthguard solidly locates and solidly secures the mandible, by way of the mandibular teeth, to the mandible while providing shock absorption or dampening in relation to the thickness of the mouthguard. (4) An upwardly directed blow to the mandible. The mouthguard of the present invention provides better protection than known prior art mouthguards against such blows because of the thickness of the mouthguard material between the mandibular and maxillary teeth, and the stabilizing influence of the inventive mouthguard. Together, these factors allow the condylar heads of the temporomandibular joints to seat in the medially braced position of the glenoid fossae. Moreover, should the wearer of the mouthguard 20 of the present invention be struck in the mandible from a direction such that the blow might tend to inflict damage to the wearer's skull or the wearer's brain contained therein, the mouthguard 20 reduces a substantial portion of the force transmitted. The mouthguard of the present invention provides better protection than known prior art mouthguards against such blows because of the energy absorbing or dampening ability of the thickness of the mouthguard portions separating teeth carried by the mandible and the maxilla between about 2 mm and about 6 mm due to the mouthguard material between the mandibular and maxillary teeth.

The groove 68 and bevel 69 are subsequently filled with a material to result in a post dam 50, which post dam 50 is complementary to the groove 68 and bevel 69, i.e. a post dam 50 having a 0.75 to 1.0 mm raised roughly hemispherical cross-sectional structure 63 with an anterior bevel 65 of roughly 45 degrees. As noted previously, the post dam 50 is an exception to the conformity of the interior surface 46 with the palate and is a generally continuous ridge upon the inwardly directed surface 46, which bears against the palatal tissue to resiliently seal the mouthguard 20 to the palate.

Subsequently, when the wearer wishes to remove the mouthguard 20, the wearer will typically observe that the mouthguard 20 cannot easily be removed by manipulation with the wearer's tongue. Rather, the wearer will typically be required to employ at least one or more fingers to deform an edge of the mouthguard 20 and thereby release the seal associated with post dam 50. Once the seal is released, air and/or saliva can easily re-enter the space 51 between the wearer's teeth and palate. This, in turn, allows the mouthguard 20 to be lowered from the maxillary teeth and subsequently expelling forwardly between the maxillary and mandibular teeth.

While not wishing to be bound by theory, the remarkable retention of the inventive mouthguard 20 in a wearer's mouth that allows a wearer to experience open-mouth breathing and speech may be more readily understood by reference and analogy to an effect hereinafter referred to as the "paper cup effect" or "Dixie® cup effect." This effect may be understood to result from the close fit and the near parallel walls of the well known nestable paper cups. When one cup is stacked upon another, they fit together closely, almost adhering to one another. The more parallel the walls of the paper cups, the more retention which can be observed between the members of the stack. In dentistry, this effect is useful in restoration design and is referred to as "retention form." Analogously, the mouthguard 20 of the present invention, in cross section, approximates two surfaces that may be considered, only for the purposes of analogy, as near parallel. The analogous effect is maximized in the present invention by extending the anterior wall upward and into the muccobuccal fold and matching that dimension (i.e. the height of extension into the muccobuccal fold) on the palatal side or posterior wall of the mouthguard 20. No other known prior art mouthguard is believed to recognize and take advantage of this analogous principle, in order to maximize retention. In another analogy, the strong retention effect may be viewed as similar to that effect which holds two sheets of glass together, particularly when water is present between the sheets of glass. Van der Waals forces or London forces account for the adhesion of the two sheets of glass.

A further possible explanation may be that capillary action due to the proximity of the surfaces of the mouth structures and the interior of the mouthguard, with a thin film of a fluid therebetween, may in part account for the strong retention characteristics of the inventive mouthguard 20.

Yet another possible analogous explanation is that "Dixie® cup effect" relates to initially small volume space 51 and an initially small (sealed or nearly sealed) opening to the small volume. Until the opening increases, the volume cannot easily be filled. The mouthguard 20 is more resilient than a paper cup such as a "Dixie® cup" and functions even better in temporarily retaining a seal. Moreover, saliva is more viscous than air and is thought to help initially and temporarily retain the seal formed by the post dam 50.

Those of ordinary skill will further recognize that various modifications can be made to the present invention without departing from the spirit of the invention.

I claim:

1. A mouthguard device for an individual wearer for mutually stabilizing maxillary teeth fitting into the mouthguard, mandibular teeth interacting with the mouthguard, a mandible and associated condylar heads seated in medially braced positions in glenoid fossae while simultaneously maintaining open-mouth breathing and speaking and muscle comfort in associated tissues, the mouthguard device comprising:

an upwardly directable U-shaped trough, the trough having a bottom, a posterior wall arising from the bottom, and an anterior wall arising from the bottom, each of the walls having an upper edge, an inwardly directed surface and an outwardly directed surface, the U-shaped trough being custom molded from a maxillary cast of the individual wearer to closely conform to the maxillary teeth and adjoining gum tissue and adjoining palatal tissue of the individual wearer;

a post dam, comprising a generally continuous ridge, upon the inwardly directed surface of the posterior wall adjacent the upper edge of the posterior wall for forming a seal with palatal tissue to increase retention of the mouthguard device in a mouth and wherein the post dam comprises a raised roughly hemispherical cross-sectional structure with an anterior bevel of roughly 45 degrees that extends laterally from a lingual free margin of an interproximal gingiva at a mesial of a first molar on one side to that of an opposite side of the mouth and resiliently contacts the wearer's gum tissue; and, wherein the outwardly directed surface on the posterior wall adjacent the bottom of the U-shaped trough interacts with crowns of the mandibular teeth to limit motion of the mandibular teeth and prevent contact of the maxillary teeth with the mandibular teeth when the mouthguard is clenched between the mandibular and maxillary teeth.

* * * * *